United States Patent [19]

Harter

[11] 4,395,220

[45] Jul. 26, 1983

[54] APPARATUS FOR FORMING CONSTRUCTION BLOCKS

[76] Inventor: Warren L. Harter, Rte. 3, Box 1038, Newport, Wash. 99156

[21] Appl. No.: 271,599

[22] Filed: Jun. 8, 1981

[51] Int. Cl.[3] ..... B28B 21/92

[52] U.S. Cl. ..... 425/413; 264/312; 425/418; 425/427; 425/457; 425/469

[58] Field of Search ..... 425/427, 413, 418, 457, 425/469; D15/138; 407/54

[56] References Cited

U.S. PATENT DOCUMENTS

| | | | |
|---|---|---|---|
| D. 262,219 | 12/1981 | Lassiter | D15/139 |
| 1,702,812 | 2/1929 | Cochran | 407/54 |
| 3,003,224 | 10/1961 | Ribich | 407/54 |
| 3,149,534 | 9/1964 | Stephens | 407/54 |
| 3,521,525 | 7/1970 | Williamson | 407/54 |

FOREIGN PATENT DOCUMENTS

| | | | |
|---|---|---|---|
| 161996 | 7/1905 | Fed. Rep. of Germany | 425/427 |
| 1174668 | 7/1964 | Fed. Rep. of Germany | 425/427 |
| 24458 | of 1911 | United Kingdom | 425/427 |

*Primary Examiner*—James H. Derrington

*Attorney, Agent, or Firm*—Wells, St. John & Roberts

[57] ABSTRACT

This invention relates to an apparatus and a process for forming building blocks by consolidating a mixture of cement and fibrous material. The process involves placing a charge of the mixture into a mold, compressing the mixture within the mold, inserting rotors into the mixture within the mold to consolidate and displace the mixture while forming hollow cores through the formed block, and removing the rotors from the formed block and the block from the mold. The apparatus includes a mold, a mold cover, means that apply pressure to the mold cover to compress the material placed within the mold rotors, means for spinning the rotors as they are lowered into and raised from the mixture by raising and lowering means. The block is formed on a removable pallet resting on lips within the mold. The pallet defines apertures substantially aligned with the rotors; the apertures allow for release of pressure when the rotors are withdrawn from the formed block. The rotors are uniquely configured to properly compact and displace the mixture and to form smooth hollow cores through the block.

10 Claims, 8 Drawing Figures

APPARATUS FOR FORMING CONSTRUCTION BLOCKS

TECHNICAL FIELD

This invention relates to an apparatus and a process for forming building blocks. The building blocks are formed by consolidating a mixture of cement and fibrous material.

BACKGROUND ART

The apparatus and process described below rates to the formation of cementicious building blocks wherein the composition of the blocks includes fibrous material. The inclusion of fibrous material produces a block that is lighter than conventional blocks and has substantially the same strength. Inclusion of fibrous material also improves sound deadening and thermal insulating qualities of the block.

Consolidation of fibrous material in a mixture with cement and additives to form construction blocks is difficult. A correct amount of even compaction is necessary to produce an acceptable block. If there is too much compaction, the block will bulge after it is removed from the form.

My U.S. Pat. No. 3,283,384 describes an apparatus for producing such composite construction blocks. My prior patent involved two longitudinal shafts, each rotatably mounted about axes parallel to one another on a platform within a framework. The blocks in the prior apparatus were formed on the floor at the construction site. The site floor was the bottom of the block form and the apparatus contained four sides and a cover to complete the form.

In my prior invention, the apparatus was placed on the floor, a charge of mixture was placed within the form, the mixture was compressed, and the two rods were rotated eccentrically to compact the mixture.

After sufficient compaction, the rods were withdrawn from the formed block leaving cores through the block. The apparatus was then lifted from the block and the formed block was left on the floor at the construction site.

My prior invention had several disadvantages in actual practice. The machine had to be moved after each block was formed; the block required a concrete pad or other such surface as a bottom to the block form; and the machine was noisy and vibrated due to the eccentric operation of the compacting rods.

DISCLOSURE OF INVENTION

The process by which the blocks are formed involves placing a controlled charge of a mixture of cement, additives, and fibrous material in a mold, compressing the mixture within the mold, compacting the mixture by axially and rotationally moving a rotor into the mixture, withdrawing the rotor from the mixture, and removing the formed block from the mold.

The apparatus for performing this process involves a confining mold, a mold cover defining an aperture, means for applying pressure to the mold cover to press the mixture into the confining mold, a rotor for displacing and compacting the material throughout the mold while producing a hollow vertical core through the block, means for inserting and withdrawing the rotor relative to the mold interior through the aperture in the mold cover, and means for rotating the rotor.

An object of this invention is to provide a simple machine for producing building blocks from a mixture of cement, additives, and fibrous material by displacing and evenly compacting within a mold the mixture from which the block is formed.

Another object of this invention is to provide a rotor means for producing building blocks from a mixture of cement, additives, and fibrous material by displacing and compacting the mixture smoothly and evenly throughout the block while producing a cylindrical hollow core through the block.

A further object of this invention is to provide a process for forming construction blocks from a mixture of cement, additives, and fibrous material.

Various other objects and advantages will become apparent upon reading the following description which, when taken with the accompanying drawings, describe a preferred form of my invention. It is to be noted, however, that the following description and drawings are given merely to set forth a preferred form of the invention and that alterations may be made within the scope of the appended claims. Therefore, only the claims are to be taken as specific definitions of what I claim to be my invention.

BRIEF DESCRIPTION OF DRAWINGS

A preferred embodiment of my invention is illustrated in the following drawings.

BEST MODE FOR CARRYING OUT THE INVENTION

Figure 1:
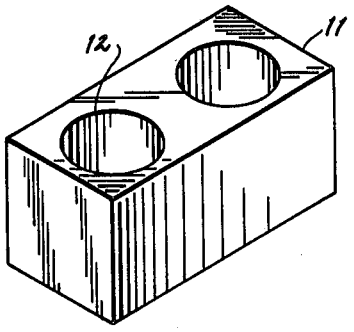
FIG. 1 is an isometric view of the cementicious block.

The block produced by this process and with this apparatus is composed of a mixture of cement, additives and fibrous material, organic or inorganic, preferably wood fibers, such as shavings, or any lightweight fibrous material. Generally, the block will be rectangular on its face and square or rectangular on its end. Any desired surface configuration can be formed on the block during the molding process, including tongue and groove configurations when desired. The various surface configurations are obtained by including an insert in one side of a mold box. If other than a smooth surface is desired, the insert would be removed with the block when the block is extruded. The block will have one or more hollow cores extending through its interior. A typical block is shown in FIG. 1 and is designated as number 11. The hollow cores are designated as number 12.

The inclusion of fibrous material in the block improves thermal and acoustic insulation properties of the block relative to conventional blocks, while producing a lighter block. The hollow cores provide openings for reinforcing steel bars and concrete during construction of walls from the blocks. The hollow cores also make a lighter block and provide channels through which wires or pipes may be run. Forming the cores is essential in the production of the block; the process of forming the cores consolidates and compacts the material from which the block is formed.

Essential to consolidating the material is the use of a proper compacting means. The fibrous material is very resilient. If the material is not compacted properly, the block can bulge out of shape when removed from the form, due to expansion of the fibrous material. This usually results from over-compaction. If the block is not sufficiently compacted, it may not be of uniform strength.

Figure 4:
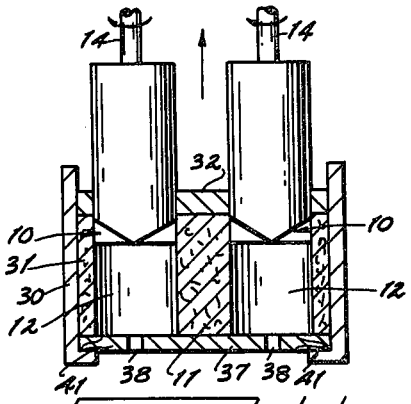
FIG. 4 is a schematic drawing showing the rotors being withdrawn from the block.

To form the blocks, a charge of material is placed within a confining mold. The material is compressed by a mold cover. Rotors are inserted through apertures in the mold cover into the mixture confined within the mold forming hollow cores. A schematic representation of the process by which the block is formed is shown in FIGS. 2 through 4.

Figure 2:
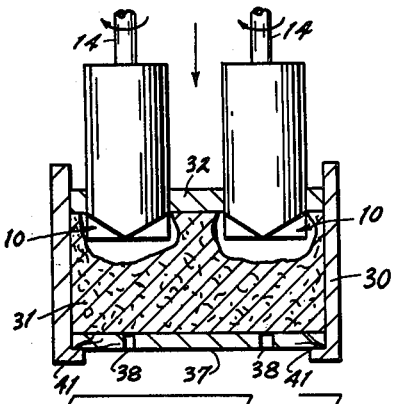
FIG. 2 is a schematic drawing showing the rotors being inserted into the mixture.
Figure 3:
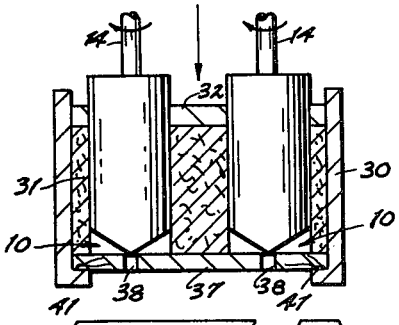
FIG. 3 is a schematic drawing showing the rotors at the bottom of the form.

The spinning rotors are inserted into the mixture confined within the mold (FIG. 2). When the rotors are at their fullest extent within the mixture, the blades of the rotors nearly touch the pallet at the bottom of the form (FIG. 3).

As the rotors enter the mixture, the mixture is radially displaced evenly and smoothly throughout the block and the hollow cores are formed. After formation of the cores, the rotors are withdrawn from the formed block through the apertures in the mold cover. After the rotors are withdrawn from the formed block, the mold cover is removed and the block is then ejected from the mold.

Figure 5:
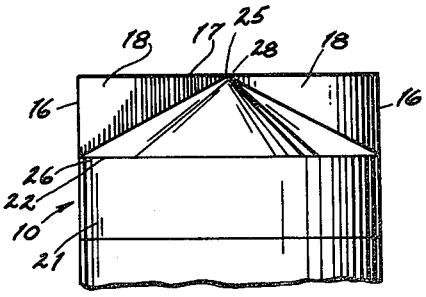
FIG. 5 is a side view of the rotor.
Figure 6:
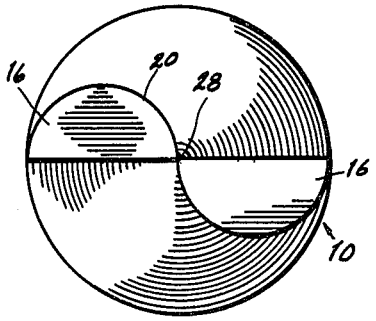
FIG. 6 is a frontal view of the rotor.
Figure 7:
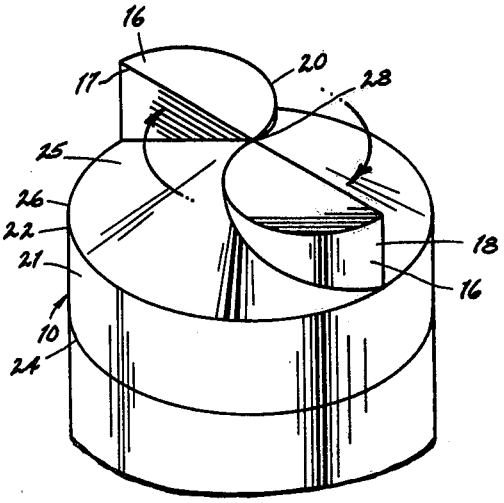
FIG. 7 is an isometric view of the rotor.

Proper consolidation and compaction of the mixture depends on the proper dispersion of the mixture by the rotor. Refer to FIGS. 5 through 7 for the following discussion of the rotor.

The rotor 10 has a smooth cylindrical outer surface 21 that has a constant radius about its center axis and also has a circumference.

A curved vane 16 projects outward from the end of cylindrical surface 21 to an edge lying within a plane perpendicular to the axis of the cylindrical surface 21. One or a plurality of vanes can be provided. In the present embodiment, there are two vanes 16. Each curved vane 16 has a transversely curved convex face 18. The face 18 is presented in the intended direction of rotation of the rotor 10. Face 18 has a radial orientation at the center axis of the cylindrical surface 21 that constantly recedes from the direction of rotor 10 rotation spirally to a tangential orientation at the circumference of the cylindrical surface 21. The two vanes 16 are arranged to form an S-shaped outer edge 20 (FIG. 6).

The rotor 10 includes a cone-shaped projection 25. The base 26 of the cone-shaped projection 25 is congruent with the outer end 22 of the smooth cylindrical outer surface 21 of the rotor 10. The apex 28 of the cone-shaped projection 25 is located along the axis of the cylindrical outer surface 21 of the rotor 10. The apex 28 of the cone 25 coincides with the edge 17 of the curved vane 16.

The rotor 10 has a round shaft 14 at its base 24 by which it is operably connected to the rotating means 36.

Figure 8:
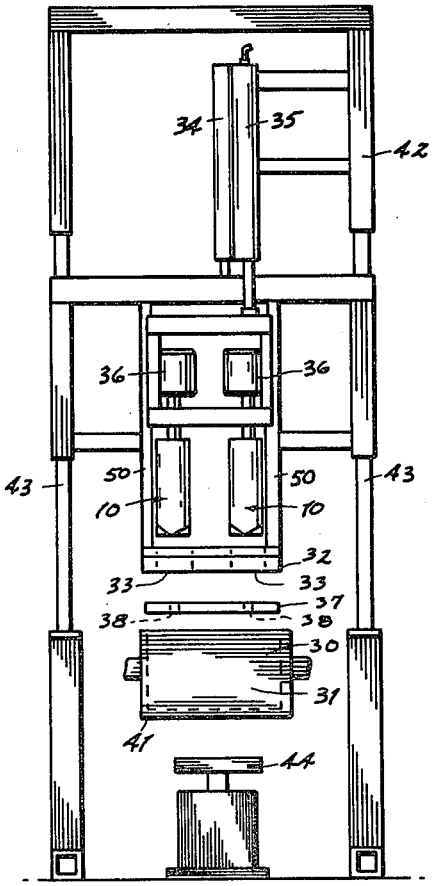
FIG. 8 is an elevational view of the block producing apparatus.

The apparatus for forming construction blocks (FIG. 8) consists of a framework 42. The framework 42 is vertical to the ground surface, although other orientations are possible. At the bottom half of the framework 42 is a confining mold 30.

The framework 42 includes tracks 43. The mold cover 32 is moved along the tracks 43 to and from the upper surface of the confining mold 30 by raising and lowering means 34, shown as a conventional hydraulic cylinder.

There are apertures 33 in the mold cover 32. The rotors 10 are raised and lowered from the mixture within the mold 30 along a track 50 by a hydraulic cylinder that serves as the rotor inserting and withdrawing means 35. Individual motors or rotating means 36 spin the rotors 10.

When the apparatus is operated, the confining mold 30 received a charge of the mixture of cement, additives, and fibrous material.

The mold cover 32 is brought down upon the charge of material within the mold 30 by the raising and lowering means 34 such that the mixture is compressed within the mold interior 31.

As the smooth cylindrical outer surface 21 of the rotor 10 is inserted into the material, the core 12 of the block 11 is formed. The outer surface 21 must be smooth, but can be other shapes than cylindrical as long as it has curved vanes for radially displacing the material; an irregular rotor 10 outer surface 21 would produce a block 11 lacking uniformity.

As the spinning rotors are lowered into the mold 30, the material within the mold 30 is pushed away from the area in contact with the rotor 10 by the faces 18 of the curved vanes 16 on the rotor 10. This action consolidates and displaces the material and also forms the hollow cores through the blocks.

When the rotors 10 have been lowered all the way to the bottom of the confining mold 30, the S-shaped outer edge 20 of the rotor vanes 17 is in contact with the movable pallet 37 at the bottom of the mold 30. When the rotors 10 are removed from the formed block, a vacuum is created in the hollow cores 12. The pallet 37 has apertures 38 substantially aligned with the rotors 10 such that the pressure of the vacuum created as the rotors 10 are withdrawn from the formed block 11 is released.

After the rotor 10 has been removed from the mold 30, the mold cover 32 is removed from the mold 30. Once the mold cover 32 is removed from the mold 30, the formed block 11 may be removed from the confining mold 30. The block 11 thus formed rests on the pallet 37. The pallet 37 rests upon lips 41 within the mold 30. When the pallet 37 is removed from the mold 30 by applying lifting pressure from beneath with a lifting means 44, the block 11 is also removed. The block 11 thus formed is set aside to cure. The block remains on the pallet 37 while curing. The apparatus is then used to produce other blocks in a like manner.

I claim:

1. A rotor for displacing and compacting materials smoothly and evenly while producing a cylindrical hollow core through a formed block, comprising:

a continuous smooth cylindrical outer surface formed about a center axis;

a curved vane projecting axially outward from one end of the cylindrical surface to an outer edge lying within a plane perpendicular to the axis of the smooth cylindrical surface;

said curve vane having a radial edge that intersects said outer edge and is an extension of said cylindrical surface;

the vane presenting a transversely curved convex face in the intended direction of rotation of the rotor;

the face of the vane having a radial orientation at the center axis of the cylindrical surface and constantly receding from the direction of rotation spirally to a tangential orientation at the cylindrical surface.

2. A rotor as defined in claim 1 including a plurality of curved vanes.

3. A rotor as defined in claim 2, wherein the vanes are configured to present an S-shaped outer edge.

4. A rotor as defined in claim 3, wherein:

the smooth surface includes a cone-shaped projection having a base centered about the center axis of the cylindrical surface;

the base of the cone being congruent with the circumference of the cylindrical surface;

the cone having an outside surface projecting outward from the end of the cylindrical surface to an apex intersecting the plane perpendicular to the axis of the cylindrical surface.

5. An apparatus for forming construction blocks from a mixture of cement and fibrous materials, comprising:

a confining mold having an interior for receiving and shaping a controlled charge of the mixture;

a mold cover having a circular aperture formed through it;

means for applying pressure to the mold cover in a first direction for pressing the mixture into the confining mold;

a rotor for displacing and compacting material smoothly and evenly while producing a cylindrical hollow core through the construction blocks, including:

(a) a continuous smooth cylindrical outer surface having a constant radius about a center axis equal to the radius of said circular aperture;

(b) a curved vane projecting axially outward from one end of the cylindrical surface to an outer edge lying within a plane perpendicular to the axis of the smooth cylindrical surface;

(c) said curved vane having a radial edge that intersects said outer edge and is an extension of said cylindrical surface;

(d) the vane presenting a transversely curved convex face in the intended direction of rotation of the rotor;

(e) the face of the vane having a radial orientation at the center axis of the cylindrical surface and constantly receding from the direction of rotation spirally to a tangential orientation at the cylindrical surface;

means for inserting and withdrawing the rotor relative to the mold interior through the circular aperture in the mold cover; and means operably connected to the rotor for rotating it about its center axis.

6. An apparatus for forming construction blocks from a mixture of cement and fibrous material as defined in claim 5 wherein the rotor includes a plurality of curved vanes.

7. An apparatus as defined in claim 6, wherein the vanes are configured to present an S-shaped outer edge.

8. An apparatus as defined in claim 5, wherein:

the cylindrical surface includes a cone-shaped projection having a base centered about the center axis of the cylindrical surface;

the base of the cone being congruent with the circumference of the cylindrical surface;

the cone having an outside surface projecting outward from the end of the cylindrical surface to an apex intersecting the plane perpendicular to the axis of the cylindrical surface.

9. An apparatus for forming construction blocks from a mixture of cement and fibrous materials as defined in claim 5, wherein said confining mold includes a movable pallet facing opposite the mold cover; said pallet containing an aperture in alignment with the rotor for venting the hollow cores of the block when withdrawing the rotor.

10. An apparatus as defined in claim 5 wherein the mold cover is horizontal and the center axis of the rotor is vertical.

* * * * *